US010920483B2

(12) United States Patent
Mutchnik

(10) Patent No.: US 10,920,483 B2
(45) Date of Patent: Feb. 16, 2021

(54) WINDOW SEAL FOR PREVENTING WATER PENETRATION

(71) Applicant: Mark Mutchnik, Miami Beach, FL (US)

(72) Inventor: Mark Mutchnik, Miami Beach, FL (US)

(73) Assignee: Mark Mutchnik, Miami Beach, FL (US)

( * ) Notice: Subject to any disclaimer, the term of this patent is extended or adjusted under 35 U.S.C. 154(b) by 170 days.

(21) Appl. No.: 16/253,268

(22) Filed: Jan. 22, 2019

(65) Prior Publication Data

US 2020/0131843 A1 Apr. 30, 2020

Related U.S. Application Data

(60) Provisional application No. 62/750,275, filed on Oct. 25, 2018.

(51) Int. Cl.

| | |
|---|---|
| ***E05D 13/00*** | (2006.01) |
| ***E06B 7/23*** | (2006.01) |
| ***E06B 3/42*** | (2006.01) |

(52) U.S. Cl.

CPC ..... *E06B 7/2318* (2013.01); *E06B 3/42* (2013.01)

(58) Field of Classification Search

CPC .... E06B 7/2318; E06B 7/2303; E06B 7/2309; E06B 7/23; E06B 3/42; E06B 3/92; E06B 3/6347; E06B 3/469; E06B 3/4609; E06B 3/4654; E06B 3/4681; E06B 1/702

USPC ..... 49/414, 415, 416, 417, 419, 423, 436, 49/437, 477.1

See application file for complete search history.

(56) References Cited

U.S. PATENT DOCUMENTS 1,402,017 A * 1/1922 Russell ..... B60J 1/2097 292/155
1,727,990 A * 9/1929 Kilberg ..... E06B 7/232 49/436
2,131,087 A * 9/1938 Austin ..... E06B 7/18 49/423
2,132,104 A * 10/1938 Froeliger ..... B60J 10/74 49/415

(Continued)

FOREIGN PATENT DOCUMENTS

DE 20218443 U1 5/2004
DE 102013013795 A1 2/2015

(Continued)

*Primary Examiner* — Jerry E Redman

(74) *Attorney, Agent, or Firm* — Dickinson Wright PLLC

(57) ABSTRACT

A water penetration prevention system includes an insert for being positioned along a track for a window, the insert having a first engaging portion disposed on a first side of the insert and a second engaging portion disposed on a second side of the insert. The system also includes a seal engaging member disposed between the first engaging portion and the second engaging portion, the seal engaging member being selectively positionable between a first position that a second position. The seal engaging member, in the second position, applies a force on at least one of the first side of the insert and the second side of the insert that causes the at least one of the first side of the insert and the second side of the insert to sealingly engage a corresponding one of the window and a vertical wall of the track.

20 Claims, 6 Drawing Sheets

(56) References Cited

U.S. PATENT DOCUMENTS 3,172,166 A * 3/1965 Imbrecht ..... E04B 2/822 52/2.11
3,745,707 A 7/1973 Herr
3,984,942 A 10/1976 Schroth
4,034,510 A * 7/1977 Huelsekopf ..... E05D 15/165 49/419
4,150,509 A * 4/1979 Knap ..... B61D 19/02 49/123
4,335,075 A * 6/1982 Kackos ..... F16J 15/46 220/232
4,372,084 A * 2/1983 Janke ..... E06B 7/2318 49/477.1
5,291,687 A * 3/1994 Abad ..... E04G 21/30 29/235
5,870,859 A 2/1999 Kitada
6,199,331 B1 3/2001 Hunt
6,286,263 B1 * 9/2001 Burrill ..... E06B 3/4609 49/469
6,305,125 B1 * 10/2001 Nozaki ..... B60J 1/17 49/415
6,305,126 B1 * 10/2001 Hendrickson ..... E05G 1/00 49/415
6,430,878 B2 * 8/2002 Terasawa ..... B60R 13/07 49/414
6,499,269 B1 * 12/2002 Beutler ..... B27M 1/08 144/345
6,854,319 B2 * 2/2005 Nunemacher ..... F27B 9/202 73/46
6,871,448 B1 3/2005 Kline
7,059,017 B1 6/2006 Rosko et al.
7,313,888 B2 * 1/2008 Ku ..... B60J 10/00 277/629
7,421,823 B2 * 9/2008 Yoshida ..... B60J 5/0402 49/415
7,448,164 B1 * 11/2008 McCabe ..... E06B 3/44 292/137
7,578,097 B2 * 8/2009 Dondlinger ..... E06B 7/2318 49/118
7,930,856 B2 4/2011 Hooper, Jr.
8,127,504 B2 3/2012 McDaniel
8,915,020 B2 12/2014 Sauter
9,080,375 B2 * 7/2015 Fleeting ..... E06B 7/26
10,428,578 B1 10/2019 Glaser
2002/0194810 A1 * 12/2002 Conachen ..... E06B 3/44 52/718.04
2004/0139668 A1 * 7/2004 Rhode ..... E06B 7/23 52/204.1
2005/0066581 A1 * 3/2005 Rhode ..... E06B 7/2316 49/414
2005/0262772 A1 * 12/2005 Zimmerman ..... E06B 3/4609 49/449
2007/0006534 A1 * 1/2007 Hiramatsu ..... B60J 10/74 49/414
2008/0209814 A1 * 9/2008 Tarjeft ..... B60J 5/0402 49/415
2020/0087979 A1 * 3/2020 Budenbender ..... E06B 7/23

FOREIGN PATENT DOCUMENTS

EP 1385540 B1 8/2011
EP 2000757 B1 9/2012
JP 04083082 A * 3/1992
JP 04146391 A * 5/1992
JP 2004217353 A 8/2004
WO 03038009 A1 8/2003
WO 2005034928 A1 4/2005

* cited by examiner

WINDOW SEAL FOR PREVENTING WATER PENETRATION

CROSS-REFERENCE TO RELATED APPLICATIONS

This application claims the benefit of U.S. Provisional Patent Application Ser. No. 62/750,275 filed on Oct. 25, 2018, and titled "WINDOW SEAL FOR PREVENTING WATER PENETRATION", the entire disclosure of which is hereby incorporated by reference.

FIELD

The present disclosure relates to window seals. More particularly, the present disclosure relates to window seals for preventing water penetration around one or more windows in a horizontal track.

BACKGROUND

This section of the written disclosure provides background information related to window seals for preventing water penetration in a horizontal track and is not necessarily prior art to the inventive concepts disclosed and claimed in this application.

Windows typically include sealing mechanisms to keep out elements such as wind, water, dirt, and insects. Such sealing arrangements typical include a seal that extends around the perimeter of the window, and in the case of horizontal sliding windows such as sliding glass doors, may also include seals between a sliding or rolling track and the frame of the window. For windows that are horizontally slideable, such seals are subject to wear due to abrasion, elements, and compressibility over time which degrades their sealing capability and effectiveness. As a result, during inclement weather, particularly severe weather such as tropical storms or hurricanes, wind-driven water can be forced by these seals due to the presence of high velocity winds and into the building interior. For example, in a high-rise apartment building having a balcony, a number of sliding glass doors may be interlocked (joined together) to allow for one or more of the sliding glass doors to open from one side to another to provide a large opening to the balcony. However, these sliding glass doors are dependent upon seals along a track, which often becomes dirty with sand or other debris and in many cases was never intended to prevent water intrusion. As a result, the sliding glass door(s) do not seal well against the track, and during severe weather, wind-driven rain can be forced around the seals and into the apartment or other interior area. Accordingly, there remains a need for improved window seals for preventing water penetration around one or more windows in a horizontal track, particularly for sliding glass doors and windows in severe weather conditions.

SUMMARY

This provides a general summary of the inventive concepts associated with this disclosure and is not intended to be interpreted as a complete and comprehensive listing of all of its aspects, objectives, features, and advantages.

An aspect of the disclosed embodiments is a water penetration prevention system for a window. The system includes an insert for being positioned along a track for a window, the insert having a first engaging portion disposed on a first side of the insert and a second engaging portion disposed on a second side of the insert opposite the first side. The system also includes at least one seal engaging member disposed between the first engaging portion of the insert and the second engaging portion of the insert, the at least one seal engaging member being selectively positionable between a first position that a second position. The at least one seal engaging member, in the second position, applies a force on at least one of the first side of the insert and the second side of the insert that causes the at least one of the first side of the insert and the second side of the insert to sealingly engage a corresponding one of the window and a vertical wall of the track.

Another aspect of the disclosed embodiments is a water sealing system that includes a seal cover configured to cover a portion of a sliding door track and being disposed proximate a sliding door in the sliding door track. The seal cover provides a sealing surface against the sliding door and the sliding door track. The system also includes at least one seal engaging member that is selectively positionable between a first position where the seal engaging member is retracted and a second position where the seal engaging member is expanded and sealingly engages the sliding door and a vertical wall of the sliding door track to provide a watertight seal between the seal cover, the sliding door, and the sliding door track.

Another aspect of the disclosed embodiments is a sealing apparatus that includes an insert having a profile corresponding to a profile of a portion of a first sliding door track disposed proximate a first sliding door in the first sliding door track. The insert includes a first engaging portion disposed on a first side of the insert and a second engaging portion disposed on a second side opposite the first side. The apparatus also includes a first static seal extending a length of the insert that engages a respective one of the first sliding door and a vertical wall of the sliding door track. The apparatus also includes a first section seal disposed on a first end of the insert and disposed perpendicularly to the vertical wall of the sliding door track. The apparatus also includes at least one seal engaging member that extends between the first engaging portion of the insert and the second engaging portion of the insert. The at least one seal engaging member is selectively positionable between a first position where the seal engaging member is retracted and a second position where the seal engaging member applies a first force on the first side of the insert and a second force on the second side of the insert. The first force causes the first side of the insert to sealingly engage the first sliding door and the second force causing the second side of the insert to sealingly engage the vertical wall of the first sliding door track.

Another aspect of the of the disclosed embodiments is a system for sealing windows to prevent water penetration around one or more windows in a horizontal track comprising any elements described, either individually or in combination with any elements, in any order.

These and other aspects of the present disclosure are disclosed in the following detailed description of the embodiments, the appended claims, and the accompanying figures.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Exemplary aspects will now be described more fully with reference to the accompanying drawings. In particular, a number of non-limiting aspects of a window seal is provided so that this disclosure will be thorough and will fully convey the true and intended scope to those who are skilled in the art. It will be apparent to those skilled in the art that specific details need not be employed, that example aspects may be embodied in many different forms and that neither should be construed to limit the scope of the disclosure. In some example aspects, well-known processes, well-known device structures, and well-known technologies are not described in detail. It should also be appreciated that the present disclosure can be utilized in connection with other types of vehicle components not described fully herein.

Figure 1:
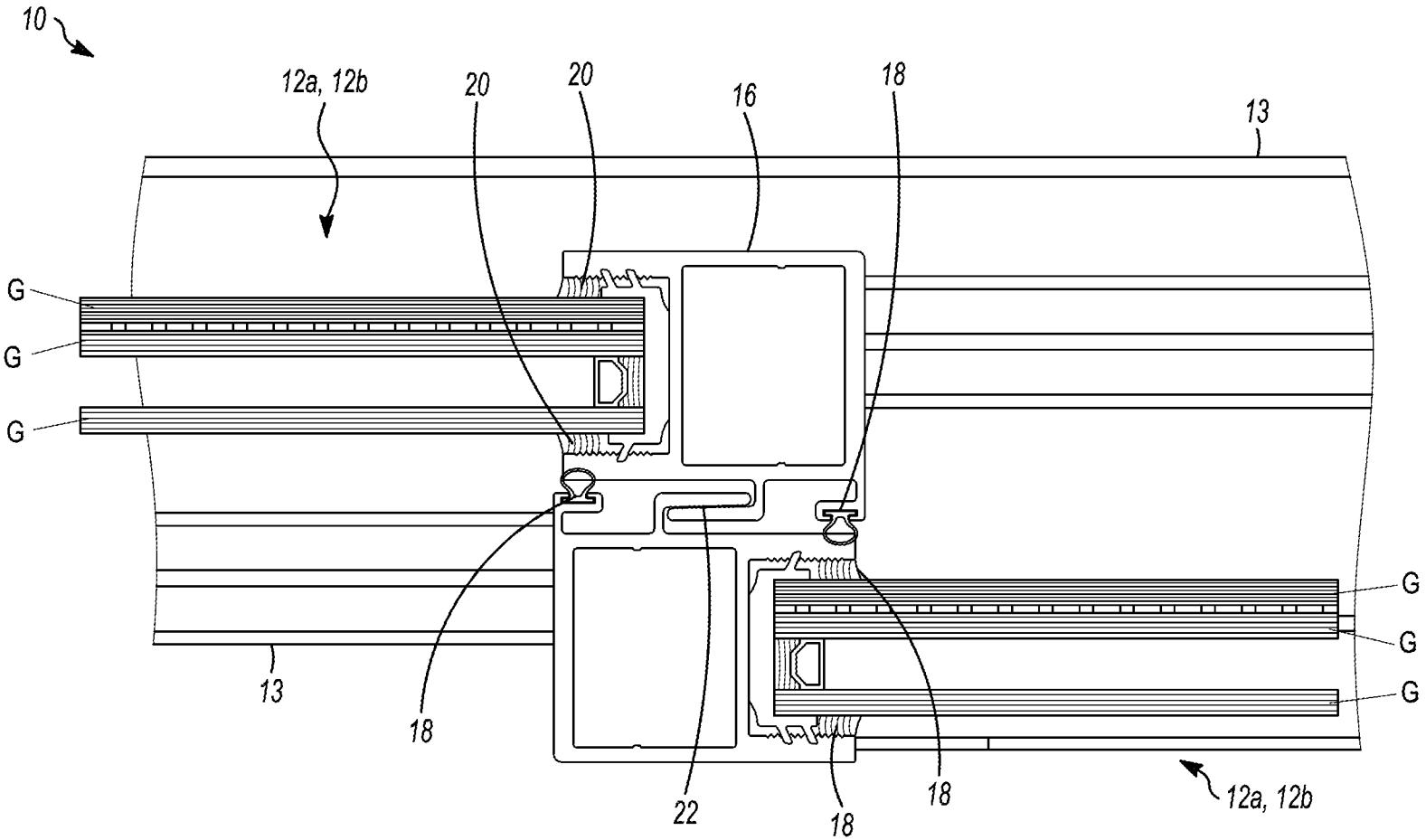
FIG. 1 generally illustrates a top cross-sectional view of a pair of sliding glass doors (or windows) that can interlock and move along a track, according to an aspect of the disclosure.

Referring generally to the figures, wherein like numerals indicate like or corresponding parts throughout the several views, a window sealing system 10 is generally shown. With reference to FIG. 1, a pair of sliding glass doors 12*a* and 12*b* are shown in cross-section, from above, in a sliding door track 13 ("track 13"). It should be understood that the terms "doors" and "windows" are used interchangeably herein.

The window sealing system 10 can include sliding glass doors 12*a*, 12*b* with one or more glass panes G, though it is contemplated that some or all of the sliding glass doors 12 can be of a solid (opaque) material, for example, aluminum or steel. The sliding glass doors 12*a*, 12*b* can be configured to move in the track 13 and can include one or more door frames 16. The door frames 16 can be constructed of sturdy materials, such as aluminum or steel, and can be configured to hold the glass panes G. The door frames 16 can include door interlock seals 18 that can be configured to seal a first sliding glass door 12*a* to a second sliding glass door 12*b* (as shown in FIG. 1). The door interlock seals 18 can be of a flexible material such as a polymer that provides a seal to prevent water, wind, or insects from passing between the two interlocked sliding glass doors 12*a*, 12*b*. The door frames 16 can also include door frame seals 20 that seal the panes of glass G in the door frames 16 as well as provide support for the panes of glass G in the door frames 16.

The door frames 16 can also include an interlock 22 that can allow the sliding glass door 12*a* to join (interlock) the sliding glass door 12*b*, for example. The joining of the sliding glass doors 12*a*, 12*b* can occur when the sliding glass doors 12*a*, 12*b* are in the closed (locked) position against a door jamb (not shown). Additionally, or alternatively, the joining of the sliding glass doors 12*a*, 12*b* can occur when the sliding glass door 12*a* is moved in the track 13 and, due to the interlock 22, the sliding glass door 12*b* can be pulled along with the sliding glass door 12*a*, such as to one side of a multi-sliding glass door opening.

Figure 2A:
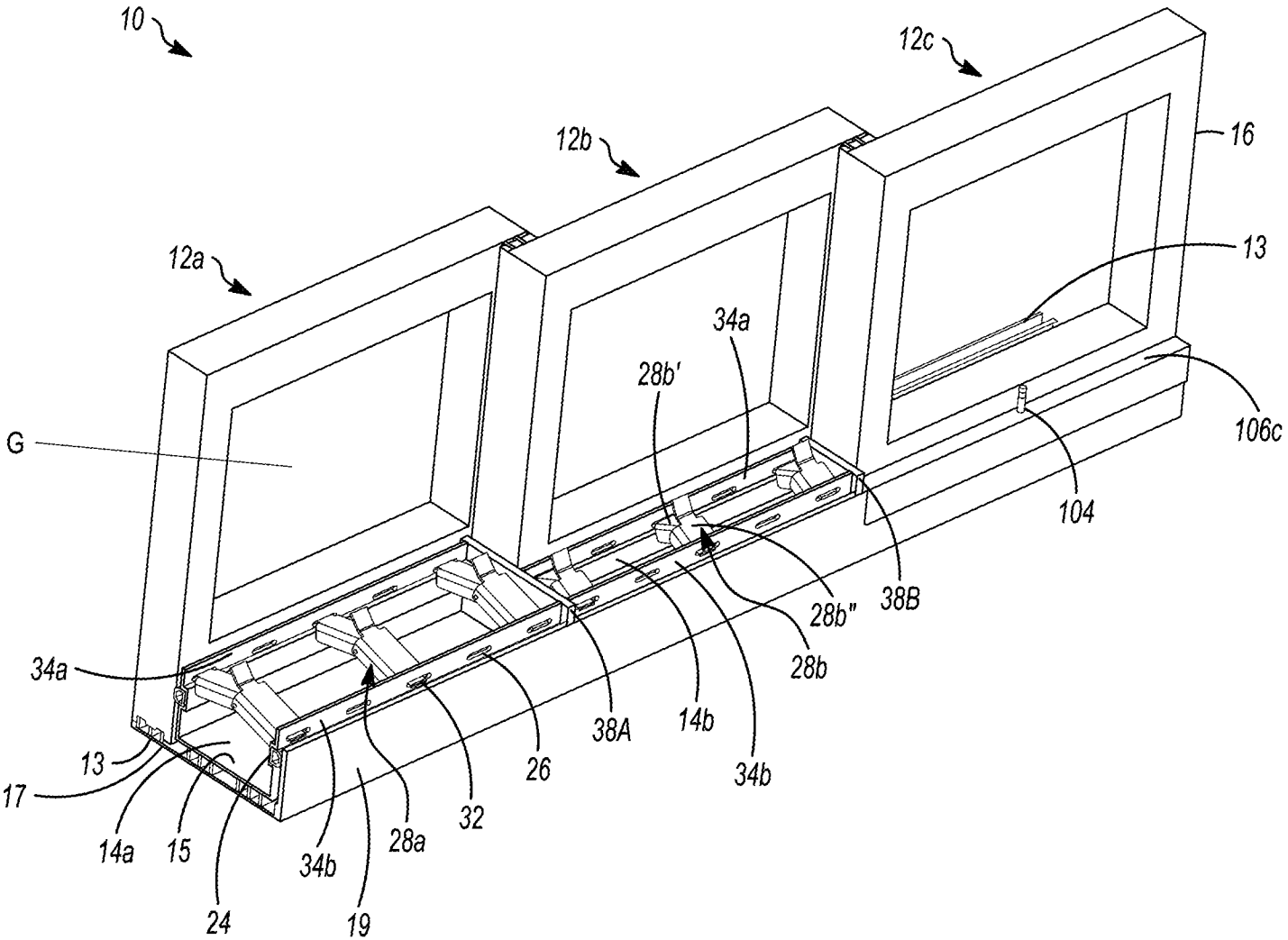
FIG. 2A generally illustrates a perspective view of three sliding glass doors that are interlocked and include a first and a second window sealing system according to an aspect of the disclosure.
Figure 2C:
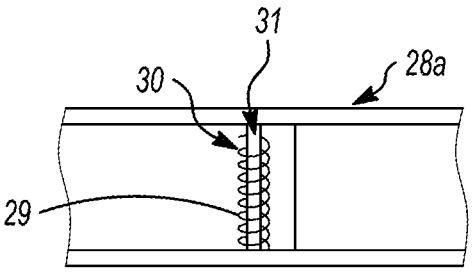
FIG. 2C generally illustrates a bottom view of a toggle latch spreader, according to an aspect of the disclosure.
Figure 2B:
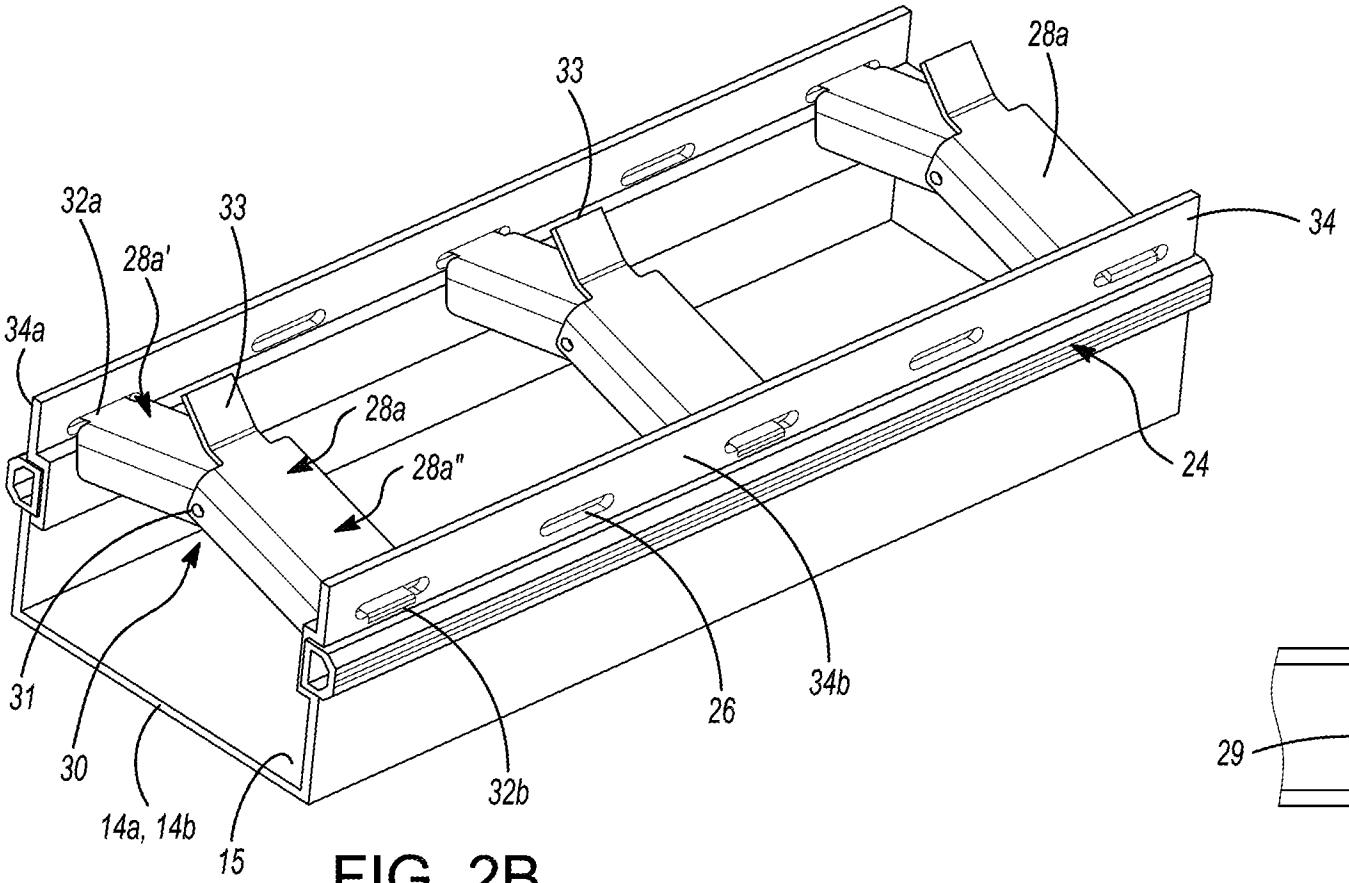
FIG. 2B generally illustrates a perspective view of the first window sealing system of FIG. 2A.

FIGS. 2A-2B present three sliding glass doors 12*a*, 12*b*, and 12*c* positioned in a track 13. The track may include a bottom 17 and one or more vertical walls 19. The sliding glass door 12*a* is shown interlocked with sliding glass door 12*b*, which is also interlocked with sliding glass door 12*c*. A window seal insert 14*a* can be inserted into the track 13 adjacent to the sliding glass door 12*a*. The window seal insert 14*a* may include a profile that corresponds to a profile of a portion of the track 13. For example, the window seal insert 14*a* includes an exterior profile that corresponds to an interior profile of a portion of the track 13 disposed proximate to the sliding glass door 12*a*. According to this embodiment, the window seal insert includes a generally rectangular-shaped base portion 15 and a pair of engaging portions 34 that extend generally perpendicular to the base portion 15 and position in spaced and parallel relationship with one another. The window seal insert 14*a* may nest into the track 13 and/or be secured to the track 13 using any suitable adhesive and/or fastener. For example, the window seal insert 14*a* may be secured to the track 13 using marine grade double sided tape, other suitable adhesive or fastener. The window seal insert 14*a* may comprise aluminum, stainless steel, other suitable material, or a combination thereof. For example, the window seal insert 14*a* may comprise bent sheet stock comprising 316 stainless steel or other suitable material.

The window seal insert 14*a* can include one or more static seals 24 that can be disposed on the window seal insert 14*a*, such as along the engaging portions 34, to engage the sliding glass door 12*a*, 12*b* and the vertical wall 19 of the track 13, in this non-limiting example. The static seals 24 can be made of a flexible material, such as a polymer, to sealingly engage the sliding glass doors 12*a*, 12*b* and the vertical wall 19 of the track 13. The static seals 24 may include one or more serrations extending along a portion of the static seals 24 that engage a respective one of the sliding glass door 12*a* or the vertical wall of the track 13. The one or more serrations are adapted to allow the static seals 24 to deflect when the static seals 24 engage the vertical wall 19 of the track 13 or sliding glass door 12*a*, 12*b*, such that, the static seals 24 conform to irregularities in the vertical wall 19 of the track 13 or sliding glass door 12*a*, 12*b*. Additionally, or alternatively, the one or more serrations may define a plurality of contact points adapted to make contact with the vertical wall 19 of the track 13 or sliding glass door 12*a*, 12*b*, such that, the one or more serrations may contain water that that enters the track 13 adjacent the static seals 24.

The engaging portions 34*a*, 34*b* of the window seal insert 14*a* can include a plurality of apertures or slots 26 spaced parallel to the track 13 and the bottom of the sliding glass door 12*a*, 12*b*. In some embodiments, the window seal insert 14*a* includes a first engaging portion 34*a* disposed on a top side wall of the widow seal insert 14*a* and extending along a length of the window seal insert 14*a* substantially parallel to the track 13. The window seal insert 14*a* may include a second engaging portion 34*b* disposed on a top side wall of the widow seal insert 14*a* opposite the first engaging portion 34 and extending along the length of the window seal insert 14*a* substantially parallel to the track 13. The slots 26 in the first engaging portion 34 can mirror the slots 26 in the second engaging portion 34, or the slots 26 may be offset. Additionally, or alternatively, the slots 26 can be configured as a single mechanical engagement and not exclusively a slot. For example and without limitation, the engaging portions 34*a*, 34*b* can be configured with teeth, notches, or with other locking elements.

The slots 26 of the window seal insert 14*a* can be configured to receive a seal engaging member, such as, a toggle latch spreader 28*a*, 28*b* that can engage one or more of the slots 26 (or other mechanical locking elements) in the engaging portions 34. The toggle latch spreader 28*a* is configured to span the window seal insert 14*a* between the engaging portions 34*a*, 34*b*. As best illustrated in FIG. 2B, the toggle latch spreader 28*a* includes a first portion 28*a*' and a second portion 28*a*". The first portion 28*a*' may extend from the first engaging portion 34*a* of the insert 14*a* to a hinge 30, and the second portion 28*a*" may extend from the second engaging portion 34*b* of the insert 14*a* to the hinge 30, opposite the first portion 28*a*'. In some embodiments, the first portion 28*a*' may include a first tab 32*a* that is configured to engage a respective slot 26 on the first engaging portion 34*a* of the insert 14*a*, and the second portion 28*a*" may include a second tab 32*b* configured to engage a respective slot 26 on the second engaging portion 34*b* of the insert 14*a*.

The first portion 28*a*' may be pivotally coupled to the second portion 28*a*" at the hinge 30. The hinge 30 may include a tab 33 disposed on a side of the toggle latch spreader 28*a* that opposes the track 13. The toggle latch spreader 28*a* can be configured to pivot about the hinge 30 and can include a biasing member 29 (shown in FIG. 2C) disposed on the hinge 30 opposite the tab 33. The biasing member 29 is configured to bias the toggle latch spreader 28*a* toward an unlocked (angled) positions. In the unlocked position, the toggle latch spreaders 28*a* may be removed from the slots 26 of the engaging portions 34*a*, 34*b*. The biasing member 29 may include a spring or spring mechanism. In some embodiments, and as is illustrated in FIG. 2C, the biasing member 29 may comprise a torsional spring 29 disposed about a rod or pin 31 of the hinge 30, however, it should be appreciated that other biasing members or mechanisms can be utilized. It should be appreciated that the biasing member 29 could alternatively be configured to bias the toggle latch spreader 28*a* toward the locked (flat) position.

With reference back to FIGS. 2A-2C, the toggle latch spreader 28*a* can be configured to apply a force on each side of the window seal insert 14*a*, such that, a first side of the window seal insert 14*a* along the first engagement portion 34*a* is pressed against the sliding glass door 12*a* and a second, opposite, side of the window seal insert 14*a* along the second engagement portion 34*b* is pressed against a vertical wall 19 of the track 13, such as the vertical wall facing an interior of a building. For example, when the toggle latch spreader 28*a* is in the locked position, a first side of the toggle latch spreader 28*a* applies a first force on a first engagement portion 34*a* of the window seal insert 14*a* and a second force on the second engagement portion 34*b*, opposite the first engagement portion 34*a*, of the window seal insert 14*a*. In some embodiments, the second force may be a force that is substantially equal in magnitude to the first force and in substantially the opposite direction of the first force.

The first force applied on the first engagement portion 34*a* of the window seal insert 14*a* causes the first engagement portion 34*a* of the window seal insert 14*a* to be pressed against the sliding glass door 12*a* and the second force applied to the second engagement portion 34*b* of the window seal insert 14*a* causes the window seal insert 14*a* to be pressed against a vertical wall 19 of the track 13 corresponding to a portion of the track 13 proximate the sliding glass door 12*a*. The first and second forces applied to the respective sides of the window seal insert 14*a* cause the window seal insert 14*a* to create a watertight seal between the sliding glass door 12*a* and the vertical wall 19 of the track 13. Thus during use, a user may press or otherwise engage the tab 33 disposed of the toggle latch spreader 28*a* toward the track 13, which pivots the hinge 30 and positions the toggle latch spreader 28*a* in the locked (flat) position. When the toggle latch spreader 28*a* is in the locked position, the toggle latch spreader 28*a* may cooperatively operate with the insert 14*a*, as described, to provide an improved sealing effect.

A force applied on the tab 33 by the user may act on the toggle latch spreader 28*a* and may translate to the first and second forces applied on respective portions of the insert 14*a*, as described. The force applied on the tab 33 by the user may include a force having a sufficient magnitude to overcome a biasing force generated by the biasing member 29 (e.g., the force applied to the tab 32 may overcome the biasing force generated by the biasing member 29).

The user may lift or otherwise engage the tab 33 of the toggle latch spreader 28*a* away from the track 13, which pivots the hinge 30 and positions the toggle latch spreader 28*a* in the unlocked position. The tab 33 may provide a visual indication of the position of the toggle latch spreader 28*a* such that a user may ensure that the tab is in the locked, sealed position. For example, when the toggle latch spreader 28*a* is in the locked position, the tab 33 may lay substantially flat against the toggle latch spreader 28*a*. Conversely, when the toggle latch spreader 28*a* is in the unlocked position, the tab 33 may extend away from the toggle latch spreader 28*a*. It should be understood that other positions or visual characteristics of the tab 33 or the toggle latch spreader 28*a* may indicate the position of the toggle latch spreader 28*a*. The visual difference between the locked (flat) and unlocked (angled) positions provides the user with a quick and easy way to visually confirm the position of the toggle latch spreaders 28*a*, particularly if many toggle latch spreaders 28*a* are in use and the sliding glass doors 12*a*-12*c* are being prepared for severe weather, for example. While only three toggle latch spreaders 28*a* are shown, it should be understood that more toggle latch spreaders 28*a* can be used, such that all available slots 26 on the engaging portions 34 of the window seal insert 14*a* can be occupied by toggle latch spreaders 28*a*.

Additionally, or alternatively, it is contemplated that one or more toggle latch spreaders 28*a* can be configured as a modular unit, such that some or all of the slots 26 can be engaged by a single multi-toggle latch spreader 28*a* sized to correspond to sliding glass door 12*a*. Additionally, or alternatively, the toggle latch spreaders 28*a* can be configured to be integrated with the window seal insert 14*a*, such that the toggle latch spreaders 28*a* are permanently or semi-permanently attached to the window seal insert 14*a*.

As best shown in FIG. 2A, a section seal 38 can be placed at either end of the window seal insert 14*a*, such as between the sliding glass door window jamb (not shown) and between a first window seal insert 14*a* and a second window seal insert 14*b*, and between a second window seal insert 14*b* and a window seal cover 106*c* to form a watertight compartment in the lengthwise direction of the window seal inserts 14*a*, 14*b* (when the toggle latch spreaders 28*a*, 28*b* are in the locked position). The section seal 38 may be disposed substantially perpendicular to the vertical wall of the track 13. In some embodiments, a second seal 38 may be placed on a first end of the window seal insert 14*a* opposite a second end of the window seal insert 14*a*. The second end of the first window seal insert 14*a* is disposed proximate the second window seal insert 14*b*. The second seal 38 placed on the first end of the window seal insert 14*a* may be inserted into a space proximate the sliding glass door 12*a*.

The second window seal insert 14*b* may include a profile that corresponds to a profile of a narrower portion of the track 13 than the portion of the track 13 at which the first window seal insert 14*a* is positioned. For example, the second window seal insert 14*b* includes an exterior profile that corresponds to an interior profile of a portion of the track 13 disposed proximate to the sliding glass door 12*b*. The window seal insert 14*b* can be inserted into the track 13 adjacent to the sliding glass door 12*b*. The window seal insert 14*b* may nest into the track 13 and/or be secured to the track 13 using any suitable adhesive and/or fastener. For example, the window seal insert 14*b* may be secured to the track 13 using marine grade double sided tape, or other suitable adhesive and/or fastener. The window seal insert 14*b* may comprise aluminum, stainless steel, other suitable material, or a combination thereof. For example, the window seal insert 14*b* may comprise bent sheet stock comprising 316 stainless steel, or other suitable material. The window seal insert 14*b* can be inserted into the track 13 adjacent to the sliding glass door 12*b*.

The section seals 38 can be configured as a flexible material, such as a polymer, to seal against the end surfaces of the window seal inserts 14*a*, 14*b*, the window seal cover 106*c*, and the sliding glass door jamb. According to an aspect of the disclosure, the section seals 38 can be configured to engage a corresponding window seal insert 14*a*, 14*b*, or window seal cover 106*a*, 106*b*, 106*c* to simplify ease of installation.

Figure 2D:
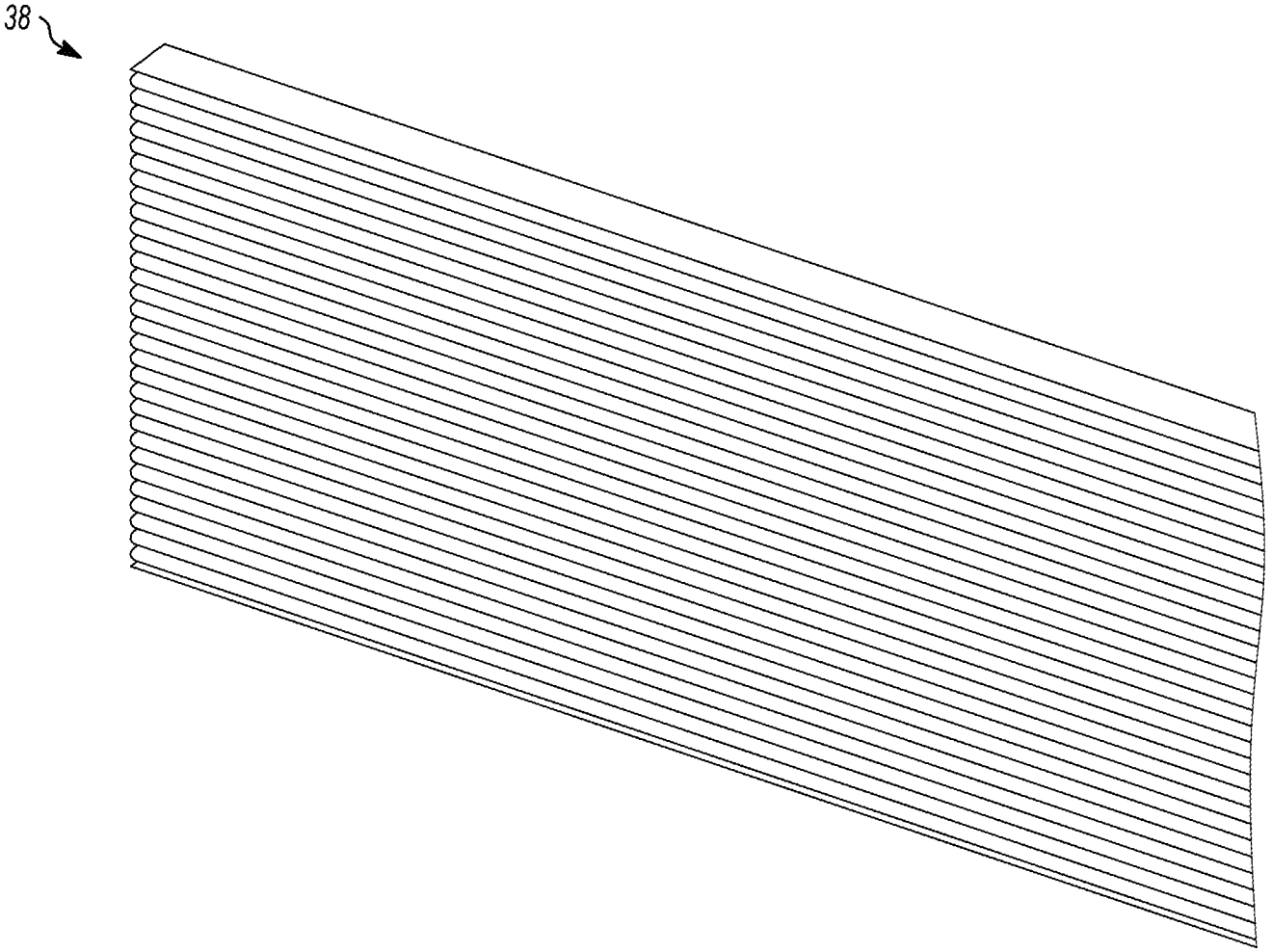
FIG. 2D generally illustrates a perspective view of a portion of a section seal according to an aspect of the disclosure.

FIG. 2D generally illustrates a perspective view of a portion of a second seal 38. The section seals 38 may include one or more serrations extending along a portion of the section seals 38 that engage the corresponding window seal insert 14*a*, 14*b*, or window seal covers 106*a*, 106*b*, and 106*c*. The one or more serrations are configured to allow the section seals 38 to deflect when the section seals 38 engage the corresponding window seal insert 14*a*, 14*b*, or window seal cover 106*a*, 106*b*, 106*c*, such that, the section seals 38 conform to irregularities in the corresponding window seal insert 14*a*, 14*b*, or window seal cover 106*a*, 106*b*, 106*c*. Additionally, or alternatively, the one or more serrations may define a plurality of contact points adapted to make contact with the corresponding window seal insert 14*a*, 14*b*, or window seal cover 106*a*, 106*b*, 106*c*, such that, the one or more serrations may contain water that that enters the window seal system 10 adjacent the section seals 38.

With reference to FIG. 2A, the slots 26 can be configured to receive a corresponding second embodiment of the toggle latch spreaders 28*b* that are generally the same as, but more narrow than the first embodiment of the toggle latch spreaders 28*a* previously discussed. The toggle latch spreaders 28*b* are configured to extend between a first engaging portion 34*a* of the window seal insert 14*b* and a second engaging portion 34*b* of the window seal insert 14*b*, which is disposed opposite the first engaging portion 34*a*. As shown, a distance between the first engaging portion 34*a* of the window seal insert 14*b* and the second engaging portion 34*b* of the window seal insert 14*b* may be less than a distance between the first engaging portion 34 of the window seal insert 14*a* and the second engaging portion 34 of the window seal insert 14*a* (e.g., the window seal insert 14*b* may have a narrower width than the window seal insert 14*a*). The operation of the second embodiment of the toggle latch spreader 28*b* is substantially identical to the operation of the first embodiment of the toggle latch spreader 28*a* described above. For example, when the toggle latch spreader 28*b* is in the locked position, the toggle latch spreader 28*b* applies a force on each side of the window seal insert 14*b*. Furthermore, a first side 28*b*' of the toggle latch spreader 28*b* applies a first force on a first side 34*a* of the window seal insert 14*b* and a second side 28*b*" of the toggle latch spreader 28*b* applies a second force on the second side 34*b*, opposite the first side 34*a*, of the window seal insert 14*b*. In some embodiments, the second force may be a force that is substantially equal in magnitude to the first force and in substantially the opposite direction of the first force.

The sliding glass door 12*c*, as shown in FIG. 2A, is the most inboard (or closest to the interior of the building). As a result, the window seal inserts 14*a*, 14*b* may not be suitable to seal the sliding glass door 12*c* in the track 13. In this aspect, a window seal cover 106*c*, can be placed over the track 13 adjacent to the sliding glass door 12*c*. Preferably, the length of the window seal cover 106*c* corresponds to the length of the sliding glass door 12*c*, including the section seals 36. The window seal cover 106*c* can provide a sealing surface against the sliding glass door 12*c* and the track 13 (in place of the slots 26 and the toggle latch spreaders 28*a*, 28*b* for sliding glass doors 12*a* and 12*b*).

Figure 3A:
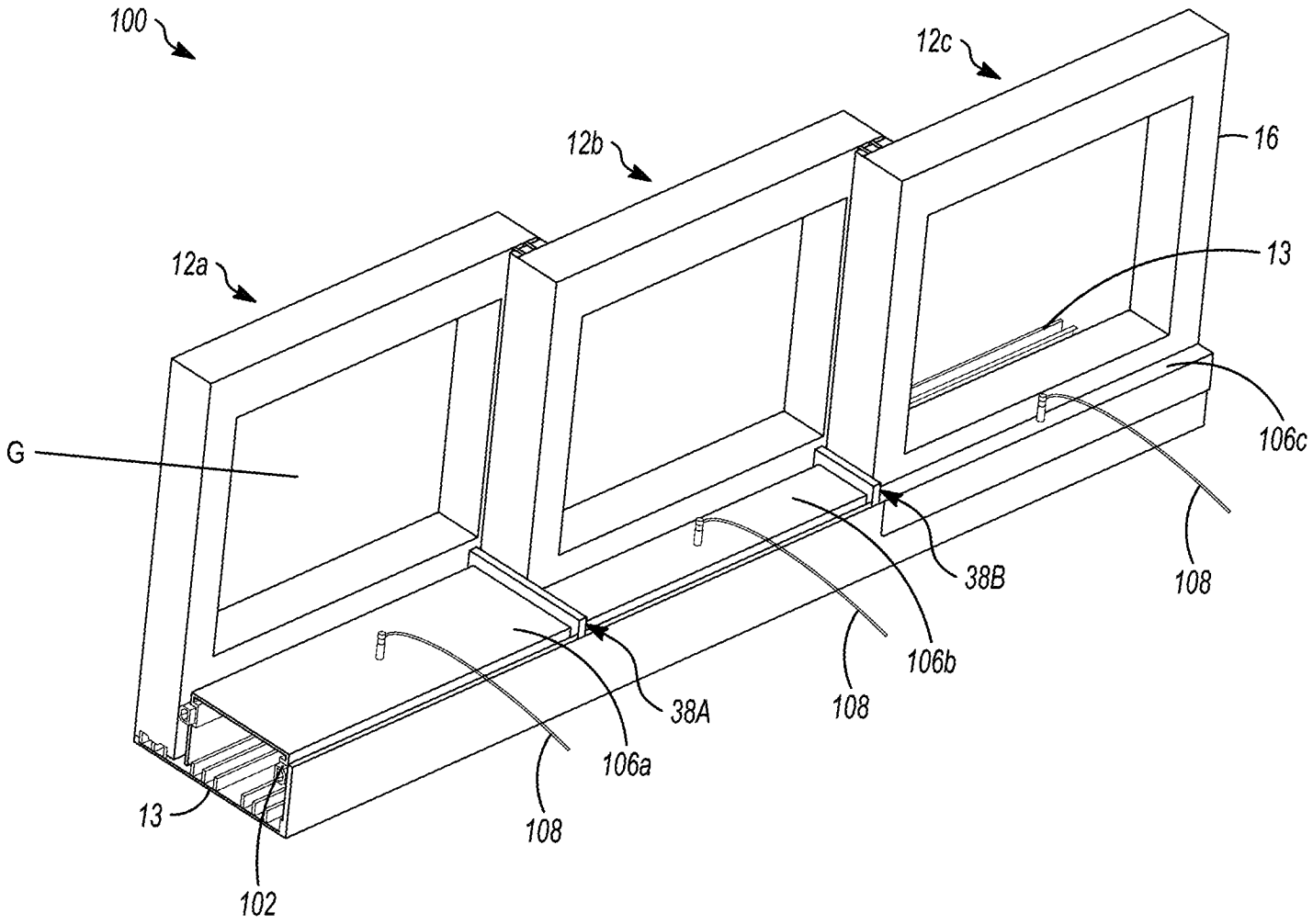
FIG. 3A generally illustrates a perspective view of three sliding glass doors that are interlocked and include the second window sealing system according to an aspect of the disclosure.
Figure 3B:
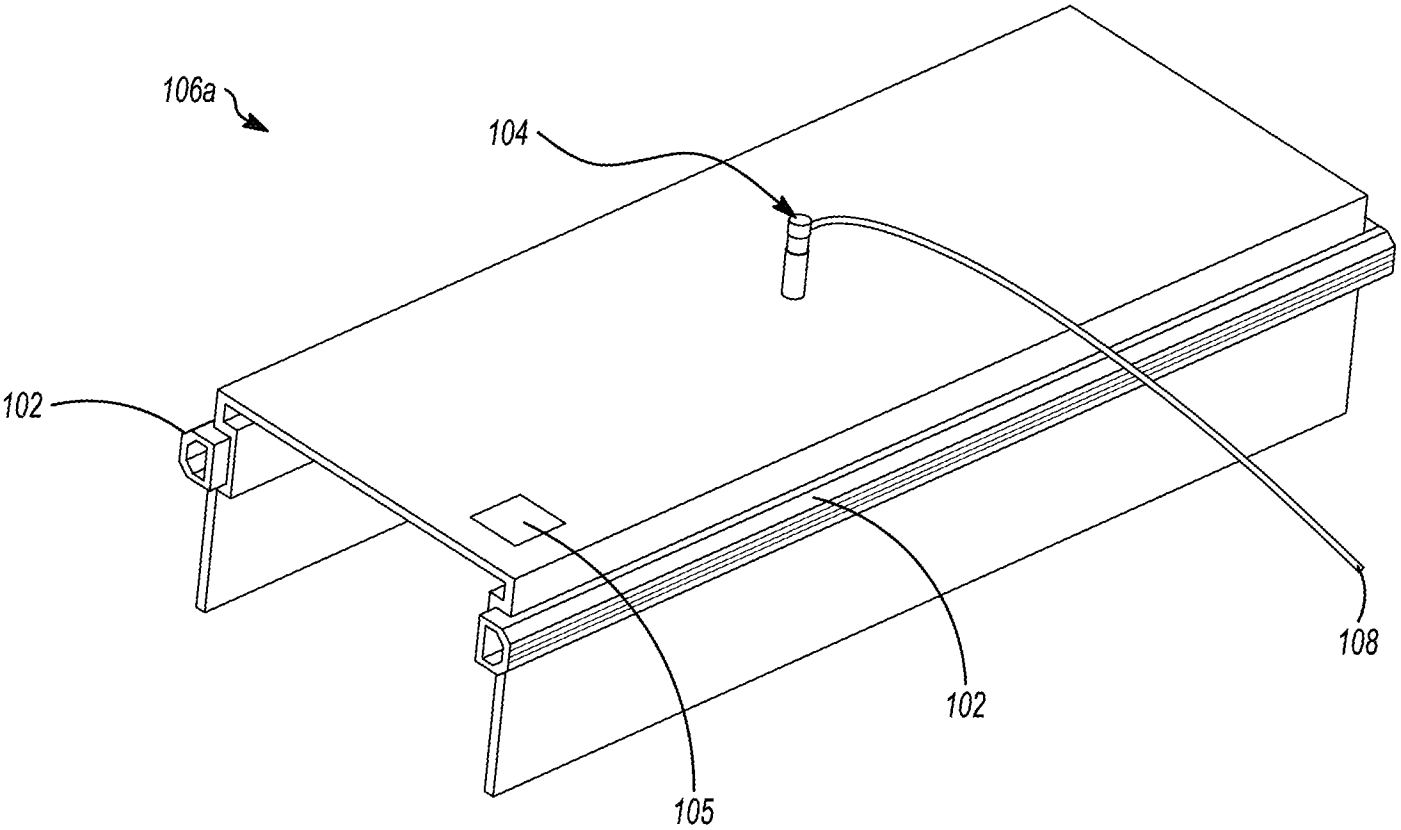
FIG. 3B generally illustrates a perspective view of the second window sealing system of FIG. 3A.

With reference to FIGS. 3A-3B, the window seal cover 106*c* can also include one or more alternative seal engaging members, such as one or more pneumatic seals 102, to form an expandable seal between the sliding glass door 12*c* and the vertical wall 19 of the track 13, particularly when pressurized air is applied to an air valve 104. The pneumatic seals 102 are fluidly connected to the air valve 104 to allow the pneumatic seals 102 to selectively be filled and deflated. The pneumatic seals 102 may be selectively positionable between a first position where the pneumatic seals 102 are deflated or retracted and a second position where the pneumatic seals 102 are inflated or expanding.

In operation, pressurized air can be applied to the air valve 104, such as from an air compressor or high pressure air reservoir (e.g., air tank) via a hose 108. The air valve 104 can be in fluid communication with the pneumatic seals 102 of the window seal cover 106*c* such that pressurized air expands the pneumatic seals 102 and provides a watertight seal between the track 13 and the window seal cover 106*c* and presses the sliding glass door 12*c* against the interlock 22 with sliding glass door 12*b* (in this non-limiting example), the door interlock seals 18, the door fame seals 20, and a door jamb (not shown). Releasing the pressurized air from the air valve 104 relieves the pressure of the pneumatic seals 102 and then allows the window seal cover 106*c* to be removed and the sliding glass door 12*c* to move in the track 13. It should be understood that the pneumatic seals 102, the air valve 104 and/or the window seal cover 106*c* can include a high pressure relief valve 105 (schematically shown) to prevent pressurized air above a predetermined threshold from damaging the pneumatic seals 102, the air valve 104 and the window seal cover 106. It should be appreciated that the air valve 104 and high pressure relief valve 105 could be located at other regions of the window seal cover 106*a*.

FIG. 3A-3B generally illustrate a window seal system 100 including three window seal covers 106*a*, 106*b*, 106*c* of different sizes for spanning different portions of the track 13. Three sliding glass doors 12*a*, 12*b*, and 12*c* are shown in the track 13. The sliding glass door 12*a* is shown interlocked with sliding glass door 12*b*, which is also interlocked with sliding glass door 12*c*. A first window seal cover 106*a* is disposed in the track 13 in alignment with the first sliding glass door 12*a*, a second window seal cover 106*b* is disposed in the track 13 in alignment with the second sliding glass door 12*b*, and a third window seal cover 106*c* is disposed in the track 13 in alignment with the third sliding glass door 12*c*. A first section seal 38A is placed in the track 13 between the first and second window seal covers 106*a*, 106*b*, and a second section seal 38*b* is placed in the track 13 between the second and third window seal covers 106*b*, 106*c*. An additional section seal can be placed at the opposite end of the window seal cover 106*c*, adjacent to a sliding glass door jamb (not shown).

In some embodiments, a water penetration prevention system for a window includes an insert for being positioned along a track for a window, the insert having a first engaging portion disposed on a first side of the insert and a second engaging portion disposed on a second side of the insert opposite the first side. The system also includes at least one seal engaging member disposed between the first engaging portion of the insert and the second engaging portion of the insert, the at least one seal engaging member being selectively positionable between a first position that a second position. The at least one seal engaging member, in the second position, applies a force on at least one of the first side of the insert and the second side of the insert that causes the at least one of the first side of the insert and the second side of the insert to sealingly engage a corresponding one of the window and a vertical wall of the track.

In some embodiments, the at least one seal engaging member includes a toggle latch spreader that includes a biasing member that biases the toggle latch spreader toward the first position. In some embodiments, the biasing member includes a torsional spring that is disposed proximate a hinge of the toggle latch spreader. In some embodiments, the toggle latch spreader includes a first portion pivotally coupled to a second portion. In some embodiments, the toggle latch spreader includes a first tab extending from the first portion that engages an aperture of the first engaging portion of the insert a second tab extending from the second portion that engages an aperture of the second engaging portion of the insert. In some embodiments, the toggle latch spreader includes a tab disposed on a side of the toggle latch spreader opposite the sliding door track. In some embodiments, the tab provides a visual indication that indicates whether the toggle latch spreader is in the first position or the second position. In some embodiments, the at least one seal engaging member includes a pneumatic seal.

In some embodiments, a water penetration prevention system includes an insert having a profile corresponding to a profile of a portion of a sliding door track and disposed in the portion of the sliding door track proximate a sliding door. The insert includes a first engaging portion disposed on a first side of the insert and a second engaging portion disposed on a second side opposite the first side. The system also includes at least one seal engaging member that extends between the first engaging portion of the insert and the second engaging portion of the insert. The at least one seal engaging member is selectively positionable between a first position where the seal engaging member is retracted and a second position where the seal engaging member applies a first force on the first side of the insert and a second force on the second side of the insert. The first force causes the first side of the insert to sealingly engage the sliding door and the second force causing the second side of the insert to sealingly engage the vertical wall of the sliding door track.

In some embodiments, the at least one seal engaging member includes a toggle latch spreader that includes a biasing member that biases the toggle latch spreader toward the first position. In some embodiments, the biasing member includes a torsional spring that is disposed proximate a hinge of the toggle latch spreader. In some embodiments, the toggle latch spreader includes a first portion pivotally coupled to a second portion. In some embodiments, the toggle latch spreader includes a first tab extending from the first portion that engages an aperture of the first engaging portion of the insert a second tab extending from the second portion that engages an aperture of the second engaging portion of the insert. In some embodiments, the toggle latch spreader includes a tab disposed on a side of the toggle latch spreader opposite the sliding door track. In some embodiments, the tab provides a visual indication that indicates whether the toggle latch spreader is in the first position or the second position.

In some embodiments, a water sealing system includes a seal cover configured to cover a portion of a sliding door track and being disposed proximate a sliding door in the sliding door track. The seal cover provides a sealing surface against the sliding door and the sliding door track. The system also includes at least one seal engaging member that is selectively positionable between a first position where the seal engaging member is retracted and a second position where the seal engaging member is expanded and sealingly engages the sliding door and a vertical wall of the sliding door track to provide a watertight seal between the seal cover, the sliding door, and the sliding door track.

In some embodiments, the at least one seal engaging member includes a pneumatic seal in fluid communication with an air value. In some embodiments, the pneumatic seal expands to the second position responsive to pressurized air being applied to the air value. In some embodiments, the seal cover includes at least one static seal extending a length of the seal cover, wherein the at least one static seal is configured to engage a respective one of the sliding door and the vertical wall of the sliding door track. In some embodiments, the at least one static seal includes serrations extending along a length of the at least one static seal. In some embodiments, the serrations are configured to allow the at least one static seal to deflect in response to the at least one static seal engaging the respective one of the sliding door and the vertical wall of the sliding door tack.

In some embodiments, a sealing apparatus includes an insert having a profile corresponding to a profile of a portion of a first sliding door track disposed proximate a first sliding door in the first sliding door track. The insert includes a first engaging portion disposed on a first side of the insert and a second engaging portion disposed on a second side opposite the first side. The apparatus also includes a first static seal extending a length of the insert that engages a respective one of the first sliding door and a vertical wall of the sliding door track. The apparatus also includes a first section seal disposed on a first end of the insert and disposed perpendicularly to the vertical wall of the sliding door track. The apparatus also includes at least one seal engaging member that extends between the first engaging portion of the insert and the second engaging portion of the insert. The at least one seal engaging member is selectively positionable between a first position where the seal engaging member is retracted and a second position where the seal engaging member applies a first force on the first side of the insert and a second force on the second side of the insert. The first force causes the first side of the insert to sealingly engage the first sliding door and the second force causing the second side of the insert to sealingly engage the vertical wall of the first sliding door track.

In some embodiments, the at least one seal engaging member includes a toggle latch spreader that includes a biasing member that biases the toggle latch spreader toward the first position. In some embodiments, the biasing member includes a torsional spring that is disposed proximate a hinge of the toggle latch spreader. In some embodiments, the toggle latch spreader includes a first portion pivotally coupled to a second portion. In some embodiments, the toggle latch spreader includes a first tab extending from the first portion that engages an aperture of the first engaging portion of the insert a second tab extending from the second portion that engages an aperture of the second engaging portion of the insert. In some embodiments, the toggle latch spreader includes a tab disposed on a side of the toggle latch spreader opposite the sliding door track. In some embodiments, the tab provides a visual indication that indicates whether the toggle latch spreader is in the first position or the second position.

The foregoing disclosure has been described in accordance with the relevant legal standards, thus the description is exemplary rather than limiting in nature. Variations and modifications to the disclosed embodiment may become apparent to those skilled in the art and do come within the scope of the disclosure. Such variations are not to be regarded as a departure from the disclosure, and all such modifications are intended to be included within the scope of the disclosure. Those skilled in the art will recognize that concepts disclosed in association with an example enclosure assembly can likewise be implemented into many other systems to control one or more operations and/or functions. Accordingly, the scope of legal protection afforded this disclosure can only be determined by studying the following claims.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer, or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

What is claimed is:

1. A water penetration prevention system for a window, comprising:

an insert for being positioned along a track for a window, the insert having a first engaging portion disposed on a first side of the insert and a second engaging portion disposed on a second side of the insert opposite the first side;

at least one seal engaging member disposed between the first engaging portion of the insert and the second engaging portion of the insert, the at least one seal engaging member being selectively positionable between a first position and a second position, wherein the at least one seal engaging member, in the second position, applies a force on at least one of the first side of the insert and the second side of the insert that causes the at least one of the first side of the insert and the second side of the insert to sealingly engage a corresponding one of the window and a vertical wall of the track;

wherein the at least one seal engaging member includes a toggle latch spreader that includes a biasing member that biases the toggle latch spreader toward the first position.

2. The system of claim 1, wherein the biasing member includes a torsional spring that is disposed proximate a hinge of the toggle latch spreader.

3. The system of claim 1, wherein the toggle latch spreader includes a first portion pivotally coupled to a second portion.

4. The system of claim 3, wherein the toggle latch spreader includes a first tab extending from the first portion that engages an aperture of the first engaging portion of the insert, and a second tab extending from the second portion that engages an aperture of the second engaging portion of the insert.

5. The system of claim 1, wherein the toggle latch spreader includes a tab disposed on a side of the toggle latch spreader opposite the biasing member, wherein the tab provides a visual indication that indicates whether the toggle latch spreader is in the first position or the second position.

6. The system of claim 1, wherein the at least one seal engaging member further includes a pneumatic seal.

7. The system of claim 1 further including a first seal extending along the first side of the insert for creating the seal between the first side of the insert and the window, and a second seal extending along the second side of the insert for creating the seal between the second side of the insert and the vertical wall of the track.

8. A water sealing system, comprising:

a track defining at least one vertical wall extending in a vertical direction;

a sliding door positioned on the track and extending generally parallel to the wall of the track, the door including a glass pane;

at least one a seal insert overlying at least a portion of the track and disposed proximate the sliding door and the wall of the track; and at least one seal engaging member that is selectively positionable between a first position where the seal engaging member is retracted and a second position where the seal engaging member is expanded and biases the seal insert against the sliding door and the vertical wall of the track to provide a watertight seal between the seal insert, the sliding door, and the track;

wherein the seal insert is located substantially below the glass pane of the sliding door in the vertical direction.

9. The system of claim 8, wherein the at least one seal engaging member includes a pneumatic seal in fluid communication with an air value.

10. The system of claim 9 wherein the pneumatic seal expands to the second position responsive to pressurized air being applied to the air value.

11. The system of claim 8, wherein the seal insert includes at least one static seal extending a length of the seal insert, wherein the at least one static seal is configured to engage a respective one of the sliding door and the vertical wall of the sliding door track.

12. The system of claim 11, wherein the at least one static seal includes serrations extending along a length of the at least one static seal.

13. The system of claim 8, wherein the at least one seal insert includes a plurality of seal inserts, and wherein a section seal is located between ends of each of the seal inserts for sealing between the seal inserts.

14. A sealing apparatus, comprising:

an insert for being positioned in a sliding door track between a sliding door and a vertical wall of the sliding door track, the insert having a first engaging portion disposed on a first side of the insert for engaging the sliding door and a second engaging portion disposed on a second side opposite the first side for engaging the vertical wall;

at least one toggle latch spreader including a first portion and a second portion being pivotally coupled to one another at a hinge, wherein the first portion engages the first engaging portion of the insert and the second portion engages the second engaging portion of the insert, and wherein the first and second portions of the at least one toggle latch spreader are selectively pivotable between a first position where the first portion and second portion are retracted toward one another and a second position where the first portion applies a first force on the first engaging portion of the insert and the second portion applies a second force on the second engaging portion of the insert such that the first and second sides of the insert are biased away from one another in order to create a seal between the first engaging portion of the insert and the sliding door and between the second engaging portion of the insert and the vertical wall.

15. The apparatus of claim 14, wherein the at least one toggle latch spreader includes a biasing member that biases the toggle latch spreader toward the first position.

16. The apparatus of claim 15, wherein the biasing member includes a torsional spring that is disposed proximate the hinge of the toggle latch spreader.

17. The apparatus of claim 15, wherein the toggle latch spreader includes a tab disposed on a side of the toggle latch spreader opposite the sliding door track.

18. The apparatus of claim 17, wherein the tab provides a visual indication that indicates whether the toggle latch spreader is in the first position or the second position.

19. The apparatus of claim 14, wherein the toggle latch spreader includes a first tab extending from the first portion that engages an aperture of the first engaging portion of the insert, and a second tab extending from the second portion that engages an aperture of the second engaging portion of the insert.

20. The system of claim 14 further including a first seal extending along the first side of the insert for creating the seal between the first side of the insert and the window, and a second seal extending along the second side of the insert for creating the seal between the second side of the insert and the vertical wall of the track.

* * * * *